US006110296A

United States Patent [19]

Zaranek

[11] Patent Number: 6,110,296

[45] Date of Patent: Aug. 29, 2000

[54] THIN STRIP CASTING OF CARBON STEELS

[75] Inventor: Richard J. Zaranek, Pittsburgh, Pa.

[73] Assignee: USX Corporation, Pittsburgh, Pa.

[21] Appl. No.: 09/067,749

[22] Filed: Apr. 28, 1998

[51] Int. Cl.[7] ..... C23C 8/22; C23C 8/26; C22C 33/04

[52] U.S. Cl. ..... 148/225; 148/226; 148/230; 148/540; 148/541; 148/546

[58] Field of Search ..... 148/541, 540, 148/221, 546, 225, 226, 228, 230, 318, 319

[56] References Cited

U.S. PATENT DOCUMENTS

| | | | |
|---|---|---|---|
| 2,760,924 | 8/1956 | Troendly . | |
| 3,928,087 | 12/1975 | Hook . | |
| 4,046,601 | 9/1977 | Hook | 148/221 |
| 4,517,031 | 5/1985 | Takasaki et al. . | |
| 4,586,966 | 5/1986 | Okamoto et al. . | |
| 4,818,299 | 4/1989 | Sato et al. . | |
| 5,089,068 | 2/1992 | Okada et al. . | |
| 5,356,493 | 10/1994 | Tsuyama et al. . | |
| 5,460,665 | 10/1995 | Yasuhara et al. . | |
| 5,484,009 | 1/1996 | Love et al. . | |
| 5,520,243 | 5/1996 | Freeman et al. . | |
| 5,531,839 | 7/1996 | Hosoya et al. . | |
| 5,578,143 | 11/1996 | Koyama et al. . | |
| 5,587,027 | 12/1996 | Tosaka et al. . | |
| 5,609,696 | 3/1997 | Lauer et al. . | |
| 5,772,795 | 6/1998 | Lally et al. | 148/221 |

FOREIGN PATENT DOCUMENTS

| | | | |
|---|---|---|---|
| 59-016158 | 8/1984 | Japan . | |
| 60-110-845 | 6/1985 | Japan . | |
| 60-217446 | 6/1985 | Japan . | |
| 60-075986 | 11/1985 | Japan . | |
| 60-221-520 | 11/1985 | Japan . | |
| 61-209923 | 5/1986 | Japan . | |
| 61-133-324 | 6/1986 | Japan . | |
| 61-253767 | 6/1986 | Japan . | |
| 61-253768 | 6/1986 | Japan . | |
| 62-205-231 | 9/1987 | Japan . | |
| 404272143 | 9/1992 | Japan | 148/221 |

*Primary Examiner*—Deborah Yee

*Attorney, Agent, or Firm*—Armstrong, Westerman, Hattori, McLeland & Naughton

[57] ABSTRACT

A substantially carbon free (e.g. 50–80 ppm carbon max.) iron base melt is strip cast to provide a cast strip having a low strength, high ductility, essentially ferrite matrix substantially free of hardening acicular ferrite, bainite and martensite phases. The strip strength may be enhanced by subjecting the strip to a carburizing or nitriding treatment either directly after casting or after casting followed by cold rolling and annealing.

20 Claims, 5 Drawing Sheets

Variation of transformation temperature with cooling rate for an 0.01C-Fe alloy. Calculated $A_3$ temperature is 1661°F (905°C)

Variation of transformation temperature with cooling rate for an 0.01C-Fe alloy. Calculated $A_3$ temperature is 1661°F (905°C)

THIN STRIP CASTING OF CARBON STEELS

BACKGROUND OF THE INVENTION

1. Field of the Invention

This invention relates to the continuous casting of thin carbon steel strip and, more particularly, to such casting of a liquid steel containing carbon in a critical maximum amount of about 60 parts per million (ppm) (0.006 weight percent) to produce a product of low strength and high ductility which later may be strengthened, as by carburizing or nitriding the cast strip.

2. Description of the Prior Art

Continuous casting of carbon steels in the form of slabs having a thickness in the range, e.g., of 8 to 10 inches, at high casting speeds, e.g., 30 to 80 inches per minute (ipm), has become very common in the steelmaking art, and today still is the conventional way to cast carbon steels. Such thick slab casting technology is well established for nearly all ranges of carbon level, including ultra-low (0.005% max.) carbon interstitial free steels, suitable for a wide variety of applications. Such technology includes the casting of very low carbon steels having relatively low strength and high ductility. An example is the use of such compositions in the manufacture of enameling steels, such as disclosed in Japanese patent numbers 60-110,845 and 60-221,520. To similar effect is U.S. Pat. No. 5,460,665 disclosing the manufacture of a conventionally cast, hot rolled, cold rolled and annealed sheet of steel having an ultra-low carbon content of 0.004% maximum. As disclosed in the latter patent, the manufacture of sheets or strip of such steels may involve post-casting processing, such as hot rolling, pickling, cold rolling, and recrystallization annealing.

Recently, there has been a trend, especially in the minimill sector, to cast thinner slabs (e.g. 2 to 4 inches thick) and at higher casting speeds, and the technology has been developed to produce steels with all ranges of carbon common to thick slab cast steels. This trend has further developed production of even thinner cast products. For example, Japanese patent number 61-133,324 shows the use of low carbon (up to 0.007%) steel in the production of thin steel ingots reduced by rolling to a thickness below 50 mm. Similarly, U.S. Pat. No. 4,586,966 discloses the production by continuous casting of thin (e.g. 10–40 mm) cast plate of low carbon (0.001–0.015%) steel which is directly cold rolled and annealed.

In the manufacture of the above-mentioned products, it is known to add certain carbide, nitride and sulfide formers, such as titanium, niobium, vanadium, zirconium, boron, etc. to affect the properties of the cast and processed steel, e.g. by forming strengthening particulates of such elements. For example, the low carbon, slab-cast enamelling steel of Japanese Patent No. 60-110,845, mentioned above, contains 0.05–0.12% titanium in order to improve the steel surface, enhance press formability and avoid fish scaling. The above-mentioned U.S. Pat. No. 4,586,966 adds titanium, niobium or zirconium to the 0.0010 to 0.015%C steel in order to remove nitrogen as nitrides of these additive elements. U.S. Pat. No. 5,578,143 is directed to the continuous slab casting of interstitial free (IF) steels of low carbon content (up to 0.005% in the base metal, and 0.01–0.08% in a surface layer) and with the addition of at least one of titanium, niobium or zirconium to combine with the carbon and nitrogen as carbides, nitrides, or carbonitrides, of the respective additives.

It is also known in the art to strengthen conventionally cast low carbon steels by carburizing or nitriding them, generally to form a hard outer layer or case on the steel. These processes may proceed by known means such as liquid or, more commonly, gas carburizing, e.g. in a natural gas atmosphere, or by nitriding, e.g. in an ammonia-containing gas atmosphere as described in U.S. Pat. No. 3,928,087, or U.S. patent application Ser. No. 08/773,205, filed Dec. 23, 1996 and assigned to the assignee hereof, which application is incorporated herein and made a part hereof by this reference.

A third technique of continuous casting of carbon steels is currently being developed; that is, strip casting at low product thicknesses, e.g. about 0.1 inch or less, and at very high casting speeds, e.g. about 1000–6000 inches per minute (ipm). Examples of thin strip casting include U.S. Pat. No. 5,484,009 disclosing a casting method and apparatus wherein liquid steel is partially cooled by a rotating casting roll, leaving an upper surface of the cast strip in liquid form which subsequently is solidified. U.S. Pat. No. 5,520,243 discloses metal strip casting wherein quality of the cast strip is a function of the roughness of the casting and cooling roll, and the metal is vibrated during casting, providing possible thicker strip with higher K value.

Metallurgically, strip casting of carbon steels is very different from conventional thick slab casting or even thin slab or plate casting, in that the cooling rates to which the strip cast steel is subjected are much higher, e.g. on the order of 2000° C. per second, and rates as high as 10,000° C./second may be involved. Such extremely high cooling rates are required in strip casting to be sure that the strip, or at least a substantial part of the thickness thereof, is solidified before leaving the mold or cooling roll surface at the extremely high casting speed necessary for practical commercial production justifying the capital investment and maintaining a competitive operating cost. The metallurgical structure produced in carbon steels is very dependent on the cooling rate during casting. Too high a cooling rate will produce undesirable phases such as acicular ferrite, bainite, or martensite, as exemplified in FIG. 1 below. These phases are much higher in strength and lower in ductility than the typical ferrite structure produced with lower cooling rates for conventional thick slab or thin slab casting. These latter cooling rates are sufficiently low that these undesirable phases are not present in sufficient quantity to adversely affect the strength or ductility of the cast products. On the other hand, the high casting speeds and resulting required high quenching rates inherently associated with thin strip casting produce a cast strip with the undesirable properties, such as high hardness and brittleness, resulting from such unavoidable metallurgical structure. Coiling of such hard, brittle strip may result in strip cracking problems. It has been suggested that "the unique metallurgical structure of acicular ferrite, bainite and martensite found in thin strip cast products is a challenging starting point for subsequent thermomechanical processing of such cast strip in order to convert the cast microstructure to an acceptable condition having better mechanical properties". (AISI Strip Casting Update: July 1997) Such additional, post-casting processing might include high temperature anneals, e.g. austenitization followed by slow cooling—which could cause scaling problems—and then pickling. Thus even if the postulated thermomechanical processing of thin cast steel strip successfully changes the undesirable cast phases to acceptable ones, the achievement likely will be at the price of further processing yield losses and costs.

SUMMARY OF THE INVENTION

This invention is based on the finding that the undesirable hardening and embrittling acicular ferrite, bainite and martensite phases produced by the very high quench rates of thin strip casting of carbon steel can be substantially avoided, and low strength, ductile steel can be produced, by strip casting substantially carbon-free iron, such as an ultra-low carbon content steel having carbon below about 80 ppm, that is, in the region of solid solution of carbon in alpha iron, denoted as "X" in the well-known iron-carbon equilibrium diagram (FIG. 2 as appears in *Metal Progress Data Sheet*, November, 1946, Page 970), preferably 60 parts per million or less, especially about 50 ppm max. Reduction of amounts of hardening bainite and martensite with decreasing carbon content at various cooling rates is illustrated in the continuous cooling transformation diagrams of FIGS. 3A, 4A and 5A, as published in 1978 by British Steel Corporation; and corresponding decrease of as-cooled hardness is shown in the corresponding prior art diagrams of FIGS. 3B, 4B and 5B. Thus-produced steel strip has a ferritic microstructure, substantially free of hardening acicular ferrite, bainite and martensite. Except for a finer grain structure, it is similar to conventionally thick or thin slab cast and slower cooled carbon steel, is relatively soft and ductile, and thereafter may be subjected to a post-casting treatment, such as carburizing or nitriding, for example, if higher strengths or lower ductilities are required.

DETAILED DESCRIPTION OF THE INVENTION

Figure 1:
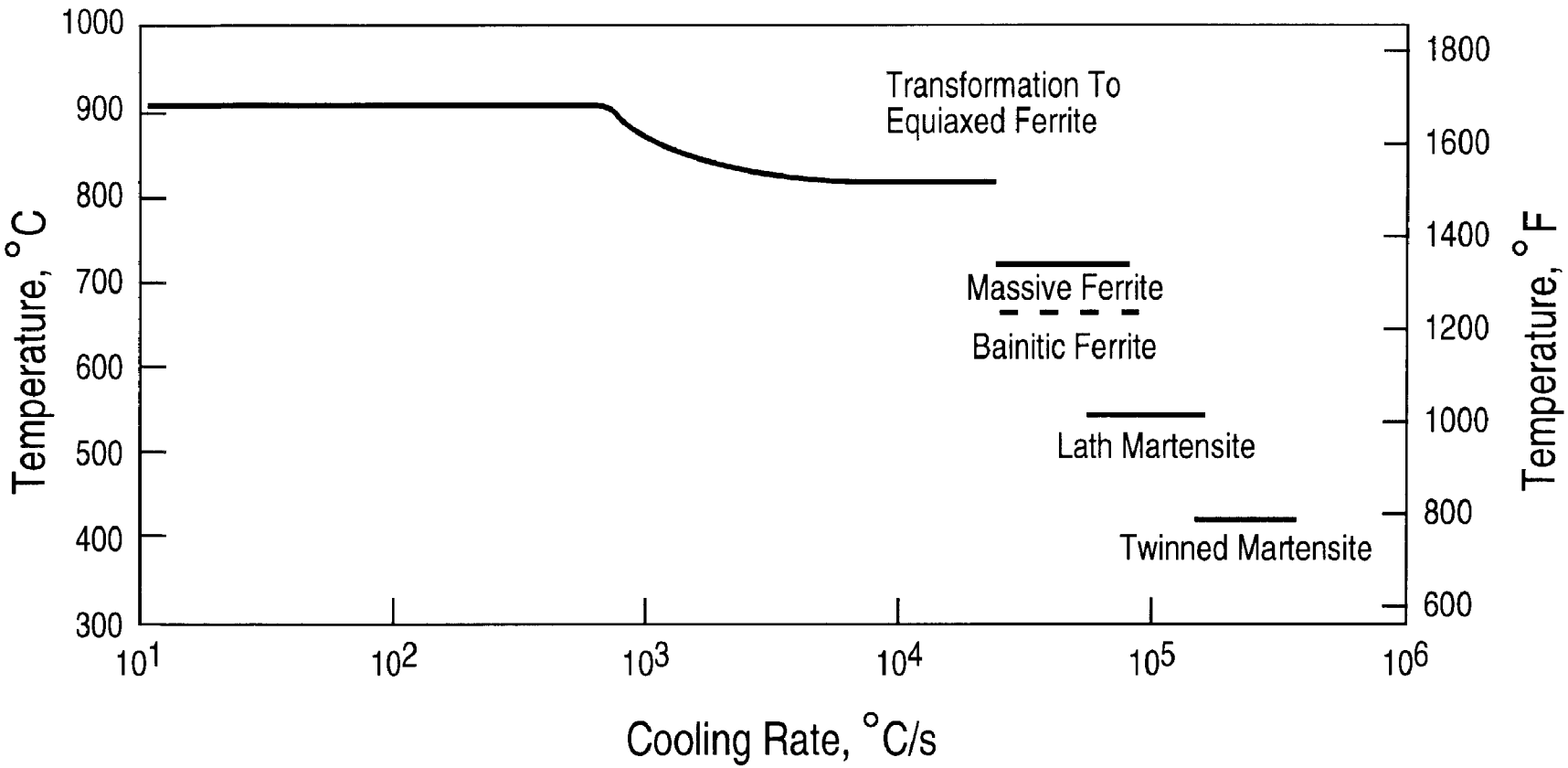
FIG. 1 Prior Art
FIG. 1 is a prior art graph relating cooling rate and transformation temperature for an iron composition containing 0.01 weight percent carbon and having a calculated $A_3$ temperature of 1661° F.
Figure 2:
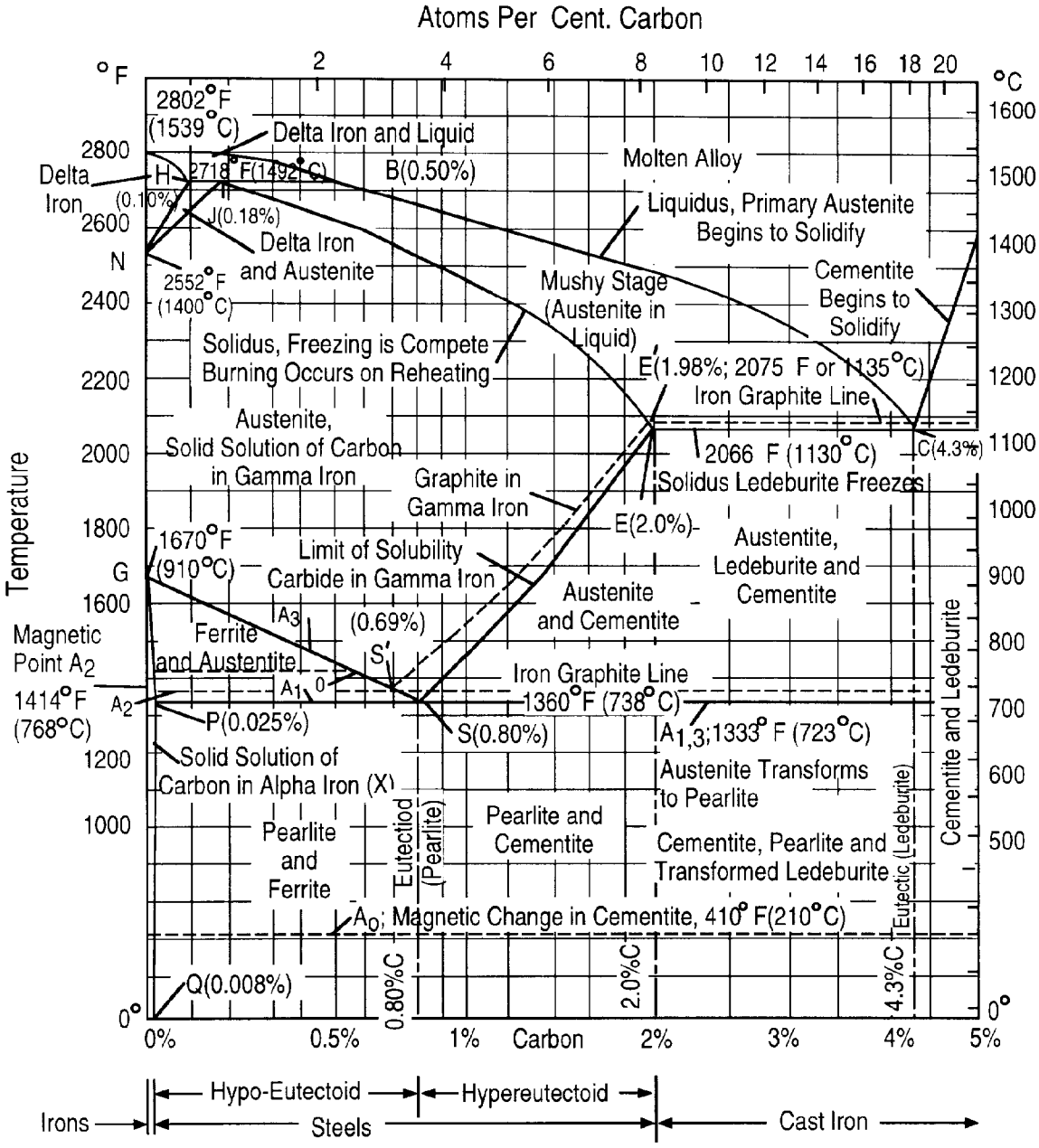
FIG. 2 Prior Art
FIG. 2 is an iron-carbon equilibrium diagram, as known to the prior art.
Figure 3A:
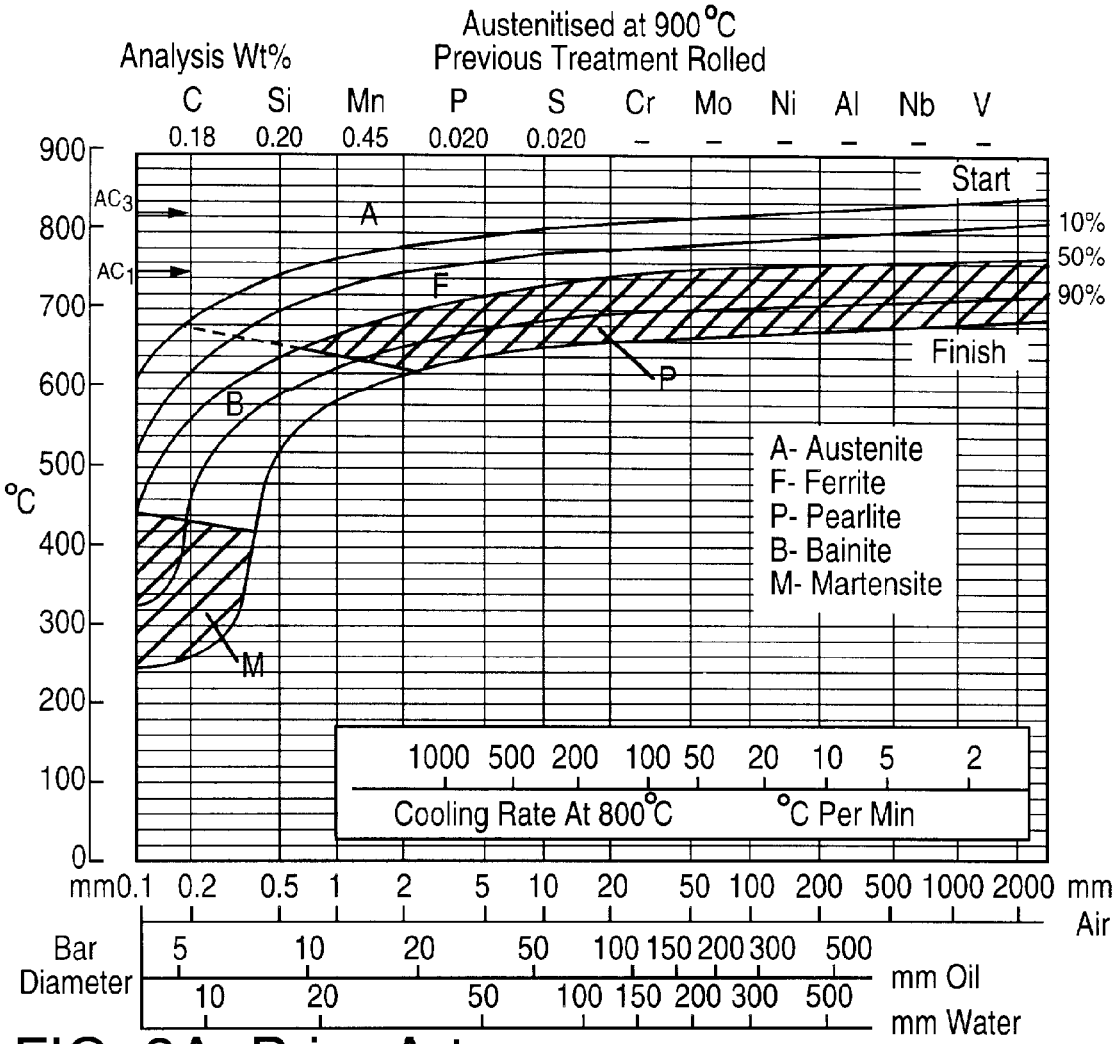
FIG. 3A Prior Art
FIGS. 3A, 4A and 5A are continuous cooling transformation diagrams, as known to the prior art, and showing reductions in the amounts of bainite and martensite produced by cooling, including very rapid cooling, at various bar diameters, of steels having, respectively, 0.18%C, 0.10%C and 0.06%C content.
Figure 3B:
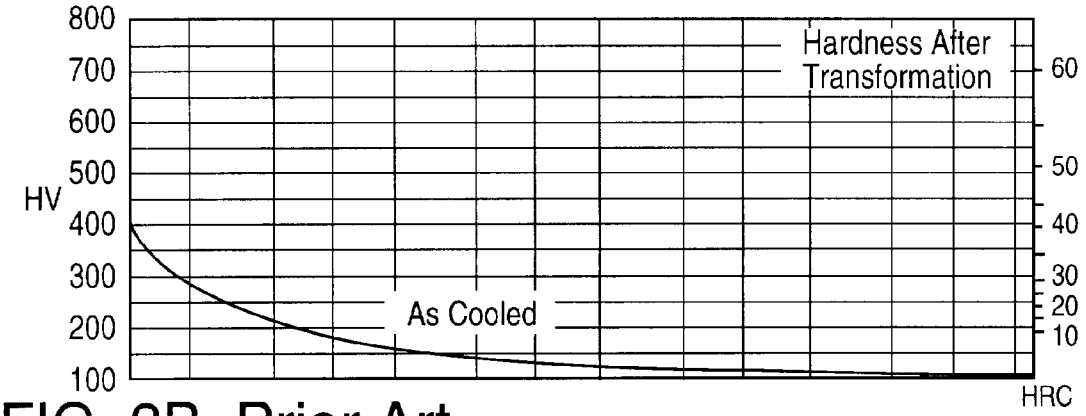
FIG. 3B Prior Art
FIGS. 3B, 4B and 5B are graphs showing the as-cooled hardnesses of the steels of, respectively, FIGS. 3A, 4A, and 5A.
Figure 4A:
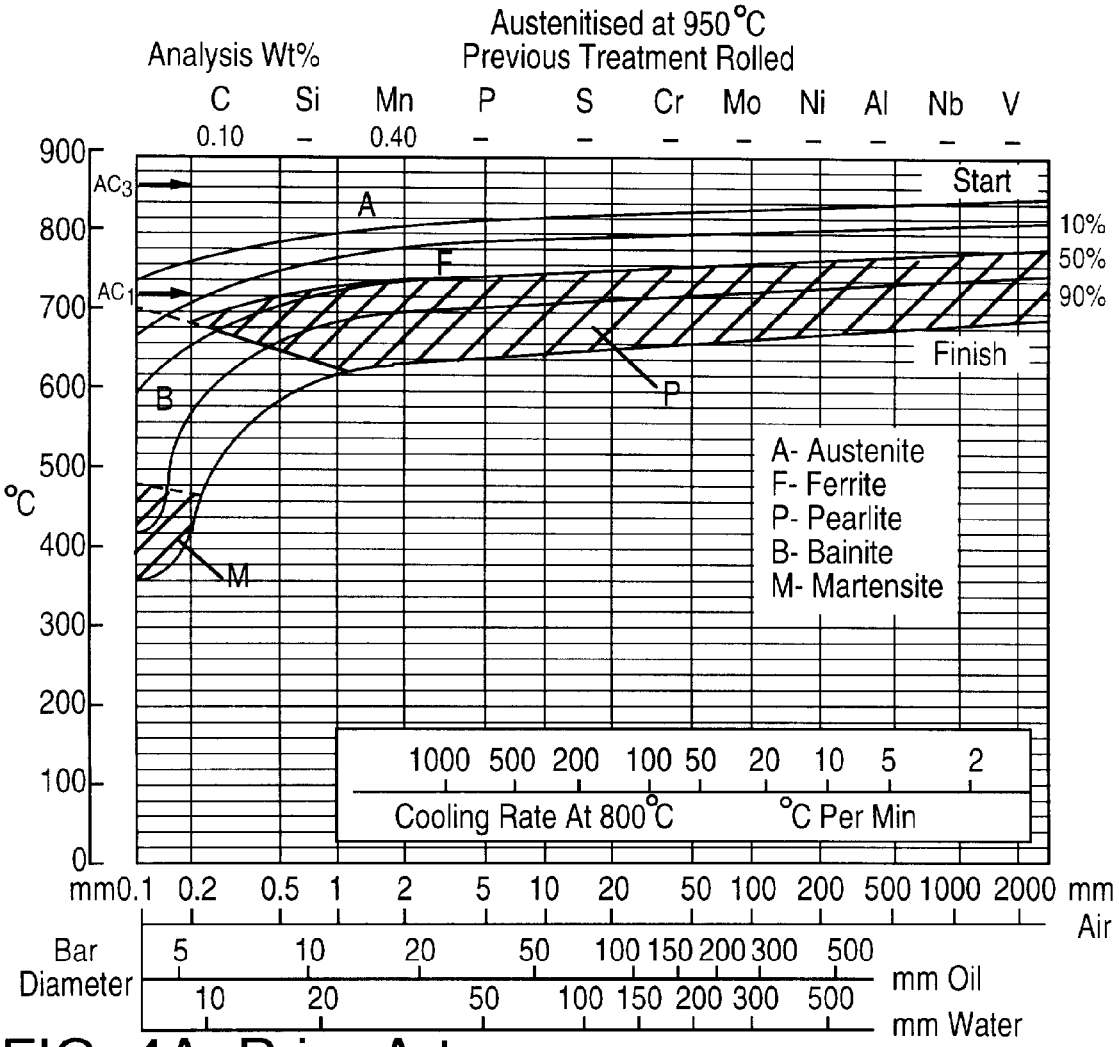
FIG. 4A Prior Art
Figure 4B:
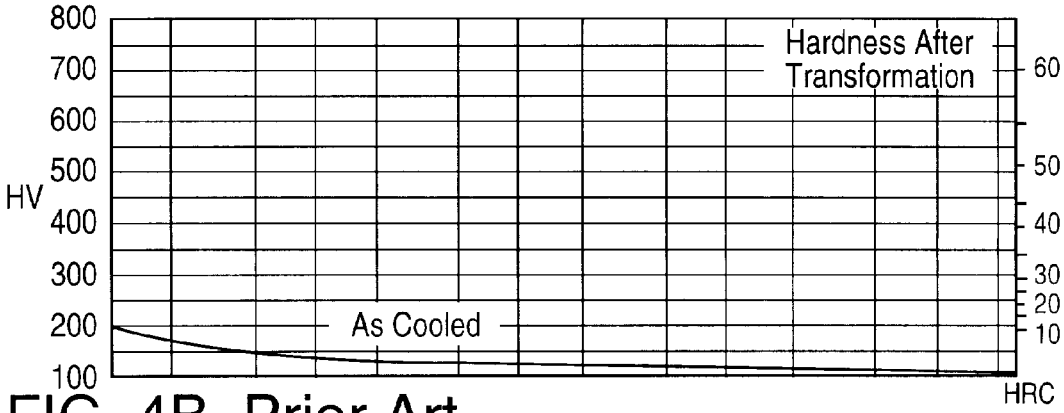
FIG. 4B Prior Art
Figure 5A:
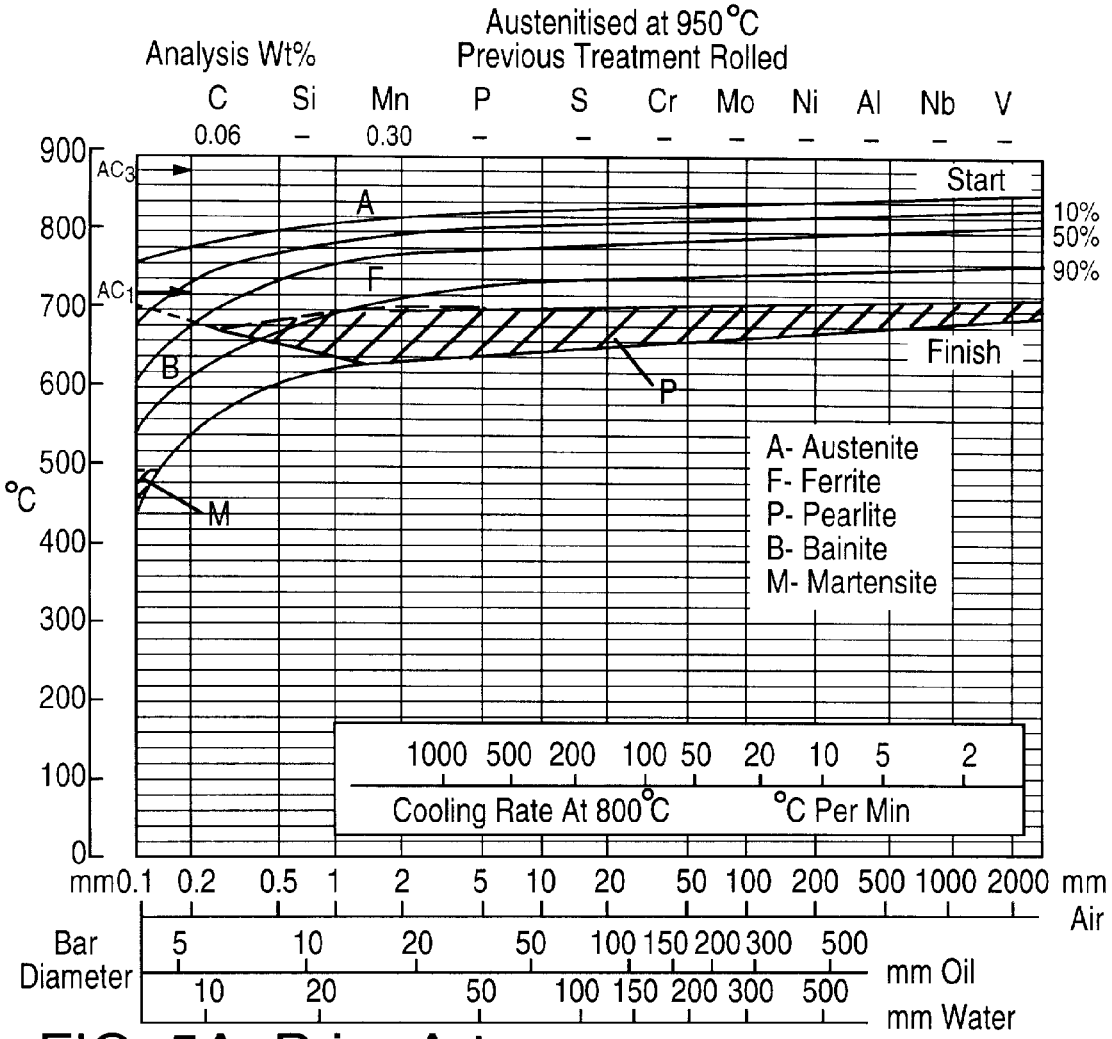
FIG. 5A Prior Art
Figure 5B:
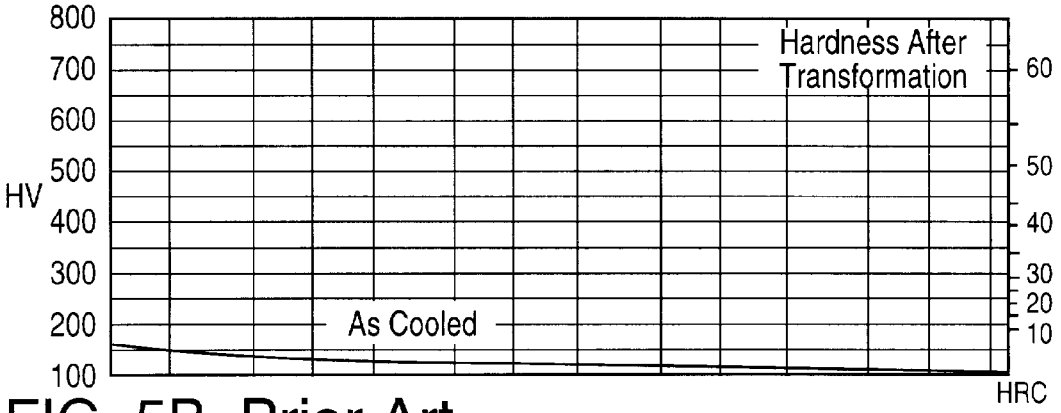
FIG. 5B Prior Art

Low carbon interstitial free steels are known and commercially produced by conventional thick and thin slab casting and applied to a wide range of applications. Examples of such steels of relatively low strength, e.g. about 20–26 ksi off-set yield strength, 40 ksi or greater ultimate tensile strength, n-value of about 0.220–0.260, and $r_m$ value of about 1.8–2.2, are set out in Table I, wherein $r_m$ is the mean plastic anisotropy, which is calculated from the Lankford value measured in the longitudinal, transverse, and diagonal directions of the sheet, and defines drawability, i.e. resistance to thinning in a tensile test; and n is a work hardening exponent measuring the slope of the log stress vs. log strain curve in the region of uniform plastic strain.

TABLE I

| Element | Steel IA[2] | Steel IB[2] | Steel IC[1] |
|---|---|---|---|
| Carbon | 0.005 max | 0.003 max | 0.005 max |
| Manganese | 0.264 max | 0.204 max | 0.254 max |
| | 0.095 min | 0.146 min | 0.095 min |
| Phosphorous | 0.020 max | 0.015 max | 0.020 max |
| Sulfur | 0.012 max | 0.009 max | 0.012 max |
| Silicon | 0.030 max | 0.020 max | 0.030 max |
| copper | 0.100 max | 0.060 max | 0.100 max |
| Nickel | 0.100 max | 0.040 max | 0.100 max |
| Chromium | 0.100 max | 0.060 max | 0.100 max |
| Molybdenum | 0.030 max | 0.020 max | 0.030 max |
| Tin | 0.030 max | 0.020 max | 0.030 max |
| Aluminum | 0.055 max | 0.054 max | 0.055 max |
| | 0.020 min | 0.020 min | 0.020 min |
| Nitrogen | 0.006 max | 0.003 max | 0.006 max |
| Niobium | 0.045 max | 0.035 max | 0.004 max |
| | 0.025 min | 0.025 min | |
| Vanadium | 0.008 max | 0.008 max | 0.004 max |
| Boron | 0.0007 max | 0.007 max | 0.007 max |
| Titanium[1] | 0.040 max | 0.040 max | 0.080 max |
| | 0.020 min | 0.020 min | 0.050 min |
| Antimony | 0.010 max | 0.010 max | 0.010 max |

[1] $Ti_{min} = (4 \times C) + (1.5 \times S) + (3.42 \times N)$

[2] $Ti = 3.42N + 1.5S$ and $Nb = 7.74C$

The steel compositions set out in Table II are representative of commercially-produced higher strength interstitial free steels.

TABLE II

| | | Steel Number | | | | | |
|---|---|---|---|---|---|---|---|
| Element | | IIA | IIB | IIC | IID | IIE | IIF |
| Carbon | max. | 0.003 | 0.005 | 0.005 | 0.005 | 0.005 | 0.005 |
| Manganese | | 0.25/ 0.35 | 0.10/ 0.25 | 0.10/ 0.25 | 0.18/ 0.33 | 0.25/ 0.35 | 0.25/ 0.35 |
| Phosphorous | | 0.03/ 0.05 | 0.025/ 0.040 | 0.025/ 0.040 | 0.04/ 0.06 | 0.04/ 0.06 | 0.035/ 0.055 |
| Sulfur | max | 0.012 | 0.012 | 0.012 | 0.012 | 0.012 | 0.012 |
| Silicon | max | 0.035 | 0.035 | 0.035 | 0.035 | 0.035 | 0.035 |
| Aluminum | | 0.02/ 0.05 | 0.02/ 0.05 | 0.02/ 0.05 | 0.02/ 0.05 | 0.02/ 0.05 | 0.02/ 0.05 |
| Nitrogen | max | 0.003 | 0.006 | 0.006 | 0.006 | 0.006 | 0.006 |
| Titanium | | 0.01/ 0.02 | 0.02/ 0.04 | 0.02/ 0.04 | 0.02/ 0.04 | 0.02/ 0.04 | 0.02/ 0.04 |
| Niobium | max | 0.03 0.04 | 0.025/ 0.045 | 0.025/ 0.045 | 0.025/ 0.045 | 0.025/ 0.045 | 0.025/ 0.045 |

TABLE II-continued

| Element | Steel Number | | | | | |
|---|---|---|---|---|---|---|
| | IIA | IIB | IIC | IID | IIE | IIF |
| Boron | 0.0006/ 0.0012 | — | 0.0006/ 0.012 | 0.0006/ 0.012 | — | 0.0006/ 0.012 |

The yield strengths of these higher strength, conventionally cast carbon steels of Table II are about 25–35 ksi, the tensile strengths are about 50+ ksi, the n-values are about 0.180–0.230 and the $r_m$-values are about 1.4–1.8.

Steels such as those given in Tables I and II and, indeed, substantially pure iron with almost no carbon (e.g. $C_{max}$=50 ppm) are useful in the practice of the present invention. Alloying elements such as manganese, silicon, phosphorous, etc. may be added to the iron base melt to provide additional strengthening in the higher strength steels, if desired. Such steels may be produced, for example, in a top- or bottom-blown oxygen furnace wherein the heat is blown to a low carbon level, e.g. about 0.03 to 0.05 wt. %, with oxygen level at about 500–900 ppm. The heat is tapped open, with no killing, or perhaps an oxygen trim with aluminum may be used if the oxygen is too high; about 200–300 ppm oxygen is needed for the subsequent carbon/oxygen reaction. The molten steel then is transferred from the ladle to a degasser, such as an RH degasser, to conduct a vacuum carbon deoxidation (VCD) reaction to reduce carbon to the desired ultra-low level. Then the steel may be killed with a deoxidant, such as aluminum; then titanium, niobium or similar carbide and nitride formers may be added to provide a stabilized interstitial free steel substantially free of carbon in solution and with any remaining carbon present as carbides in a ferrite matrix.

I have found that, even when strip cast at the necessary rapid cooling rates, these steels are ferritic, i.e. polygonal or equiaxed ferrite, similar to the structure of conventional slab cast steel. Such cast strip is free of the above-mentioned undesirable hardening phases and is soft and ductile, with mechanical properties similar to those of conventionally thick or thin slab cast products, and useful, in the as-cast condition, for many practical applications such as automotive body parts, appliances, enamelling, etc. Although such products may be subjected to further thermomechanical processing such as cold rolling and annealing, they provide, for the first time in the art, the possibility of practical application directly in the as cast condition. To broaden the possible field of applications, e.g. those requiring higher strength with similar or lower ductility, this invention includes subjecting the cast strip product to a strengthening carburizing or nitriding treatment. Because the strip, as cast, is very thin, e.g. 0.10 to 0.125 inch or less, it is possible, within practical time limits, to carburize or nitride the full thickness of the strip to provide uniform through thickness mechanical properties. If the steel, as cast, contains no carbide/nitride formers, such as titanium, niobium, zirconium, vanadium, boron, etc., on carburizing, the steel is strengthened mainly by free carbon in solution in the iron matrix. If carbide formers are present, particle strengthening may occur due to carbide precipitation. As above noted, the steel contains one or more of the aforesaid nitride formers when the steel is to be strengthened by nitriding, after which the thus-treated steel has a higher strength, e.g. yield strength of 45 ksi or more as a function of nitride particle hardening and, to a lesser extent, from the presence of excess soluble nitrogen, and $r_m$-value at least up to 1.8, especially after cold rolling. Thus, to further improve $r_m$-value and n-value, the as-cast strip may be subjected to further processing, as cold rolling prior to annealing, but an important object of the invention is to provide final products in the form of the as-cast steels, either as-is, or strengthened by carburizing or nitriding.

In view of the above-mentioned major difficulties being encountered in the development of strip casting, this invention of casting an almost pure iron with almost no carbon, followed by a strengthening post-treatment such as carburizing or nitriding, provides, for the first time, an economical way to avoid those difficulties and to produce, by strip casting, a wide range of commercially useful products.

What is claimed is:

1. A method of metal casting comprising strip casting a substantially carbon-free iron base material having a maximum carbon content of about 80 ppm in the form of a thin, low strength, high ductility strip having an essentially ferritic microstructure substantially free of hardening acicular ferrite, bainite and martensite phases.

2. A method according to claim 1, further comprising subjecting the strip to a strengthening treatment directly after casting or after casting followed by cold rolling of the cast strip.

3. A method according to claim 2, wherein the strengthening treatment is selected from the group consisting of carburizing and nitriding.

4. A method according to claim 1, comprising limiting carbon to a maximum amount of about 60 ppm.

5. A method according to claim 2, comprising limiting carbon to a maximum amount of about 60 ppm.

6. A method according to claim 3, comprising limiting carbon to a maximum amount of about 60 ppm.

7. A method according to claim 1, comprising limiting carbon to a maximum amount of about 50 ppm.

8. A method according to claim 2, comprising limiting carbon to a maximum amount of about 50 ppm.

9. A method according to claim 3, comprising limiting carbon to a maximum amount of about 50 ppm.

10. A method according to one of claims 1–9, comprising casting the strip to a maximum thickness of about 0.125 inch.

11. A method according to one of claims 2–9, wherein the strengthening treatment is accomplished by exposing the strip in coiled form to a carburizing or nitriding gaseous atmosphere in an open coil annealing furnace.

12. A method ofproducing a thin, high strength and ductile metal strip without hot or cold rolling, comprising strip casting a substantially carbon free iron base melt having a maximum carbon content of about 80 ppm, thereby forming a low strength, high ductility cast strip of essentially ferritic microstructure substantially free of hardening acicular ferrite, bainite or martensite, and subjecting the as-cast strip to a strengthening treatment selected from the group consisting of carburizing and nitriding carried out in an open coil annealing furnace.

13. A method according to claim 12, comprising limiting the carbon to a maximum of about 60 ppm.

14. A method according to claim 13, comprising casting the strip in a thickness less than about 0.125 inch, and carburizing the strip through substantially the full thickness thereof.

15. A method according to claim 13, comprising casting the strip in a thickness less than about 0.125 inch, and nitriding the strip through substantially the full thickness thereof.

16. A method according to claim 13, wherein the cast strip has an 0.2% off-set yield strength of about 20–26 ksi, an ultimate tensile strength of at least 40 ksi, and an n-value of about 0.220–0.260.

17. A method according to claim 16, wherein, after the cast strip is subjected to the strengthening treatment, it has an 0.2% off-set yield strength of at least about 40 ksi.

18. A method according to claim 2, further comprising first deoxidizing the substantially carbon-free iron base material, and adding thereto an amount of at least one carbide- and nitride-forming element sufficient, on subjection of the strip to the strengthening treatment, to provide carbide or nitride particle strengthening of the ferrite matrix of the steel strip.

19. A method according to claim 18, wherein the carbide- and nitride-forming element is selected from the group consisting of titanium, niobium, vanadium, boron and mixtures thereof.

20. A method of producing a fabricable steel strip, comprising strip casting a molten iron-base material having a maximum carbon content of about 80 ppm to form a cast strip having a substantially ferrite microstructure substantially free of hardening acicular ferrite, bainite and martensite and having an 0.2% off-set yield strength under about 30 ksi, further treating the strip in a condition selected from the group consisting of as-cast, cold rolled and annealed conditions by a strengthening treatment selected from the group consisting of carburizing and nitriding a coil of the strip in an open coil annealing furnace, thereby increasing the strength of the strip and retaining a ductility useful for fabricating the strip.

* * * * *